US006945203B2

(12) United States Patent
Amend et al.

(10) Patent No.: US 6,945,203 B2
(45) Date of Patent: Sep. 20, 2005

(54) TWO-CYCLE ENGINE

(75) Inventors: Helmar Amend, Waiblingen (DE); Klaus-Martin Uhl, Baltmannsweiler (DE); Werner Geyer, Berglen (DE); Claus Fleig, Ludwigsburg (DE)

(73) Assignee: Andreas Stihl AG & Co KG (DE)

( * ) Notice: Subject to any disclaimer, the term of this patent is extended or adjusted under 35 U.S.C. 154(b) by 235 days.

(21) Appl. No.: 10/444,358

(22) Filed: May 23, 2003

(65) Prior Publication Data

US 2005/0045124 A1 Mar. 3, 2005

(30) Foreign Application Priority Data

May 24, 2002 (DE) ..... 102 23 068
Mar. 19, 2003 (DE) ..... 103 12 092

(51) Int. Cl.[7] ..... F02B 33/04
(52) U.S. Cl. ..... 123/73 PP; 123/73 AV
(58) Field of Search ..... 123/73 PP, 73 AV

(56) References Cited

U.S. PATENT DOCUMENTS 6,367,432 B1 4/2002 Araki
6,571,756 B1 6/2003 Rosskamp et al.
2002/0020370 A1 * 2/2002 Araki ..... 123/73 PP
2002/0043227 A1 4/2002 Carlsson et al.
2003/0217709 A1 * 11/2003 Geyer et al. ..... 123/73 PP
2003/0217711 A1 * 11/2003 Geyer et al. ..... 123/73 PP
2003/0226526 A1 * 12/2003 Rosskamp et al. ..... 123/73 PP
2004/0182338 A1 * 9/2004 Amend et al. ..... 123/73 PP
2004/0255883 A1 * 12/2004 Yuasa et al. ..... 123/73 A
2005/0022757 A1 * 2/2005 Yamaguchi et al. ..... 123/73 PP

FOREIGN PATENT DOCUMENTS

DE 26 50 834 6/1977
EP 0 337 768 10/1989
EP 1 176 296 1/2002

* cited by examiner

*Primary Examiner*—John T. Kwon
(74) *Attorney, Agent, or Firm*—Robert W Becker & Associates; Robert W Becker

(57) ABSTRACT

A two-cycle engine is provided, especially in a manually-guided implement such as a power chain saw, a brush cutter, a trimmer or the like, and has a cylinder in which is formed a combustion chamber that is delimited by a reciprocating piston that, via a connecting rod, drives a crankshaft that is rotatably mounted in a crankcase. In prescribed positions of the piston, the combustion chamber is connected with the crankcase via at least two transfer channels. At least one air channel is provided that opens out at an air channel window at the cylinder in the region of the piston, and that, in prescribed positions of the piston, is connected with at least two transfer channels via a piston window formed in the piston. To achieve a good scavenging of the combustion chamber, and hence low exhaust gas values of the engine, structural features are provided on the piston window for the defined distribution of air to the transfer channels.

14 Claims, 4 Drawing Sheets

TWO-CYCLE ENGINE

BACKGROUND OF THE INVENTION

The present invention relates to a two-cycle engine, especially in a manually-guided implement such as a power chain saw, a brush cutter, a trimmer, or the like.

EP 1 176 296 A1 discloses a two-cycle engine, the transfer channels of which are in connection with an air channel via a piston window in prescribed positions of the piston. By means of the air channel and the piston window, largely fuel-free air is supplied to the transfer channels. The air separates the exhaust gases, which in the region of the lower dead center position flow out of the combustion chamber, from the fuel/air mixture, which passes from the crankcase into the combustion chamber. Due to the geometrical configuration of the piston window and of the transfer window, with such two-cycle engines generally no optimum distribution of the air to the transfer channels can be achieved, so that less fuel-free air can be supplied to one of the transfer channels than to the other, as a result of which the fuel/air mixture that subsequently flows into this transfer channel is partially carried-away with exhaust gases through the outlet. A clean separation of exhaust gases and fuel/air mixture cannot be achieved with such a known configuration.

It is therefore an object of the present invention to provide a two-cycle engine of the aforementioned general type whereby a good separation of exhaust gases and subsequently flowing-in fuel/air mixture can be achieved.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
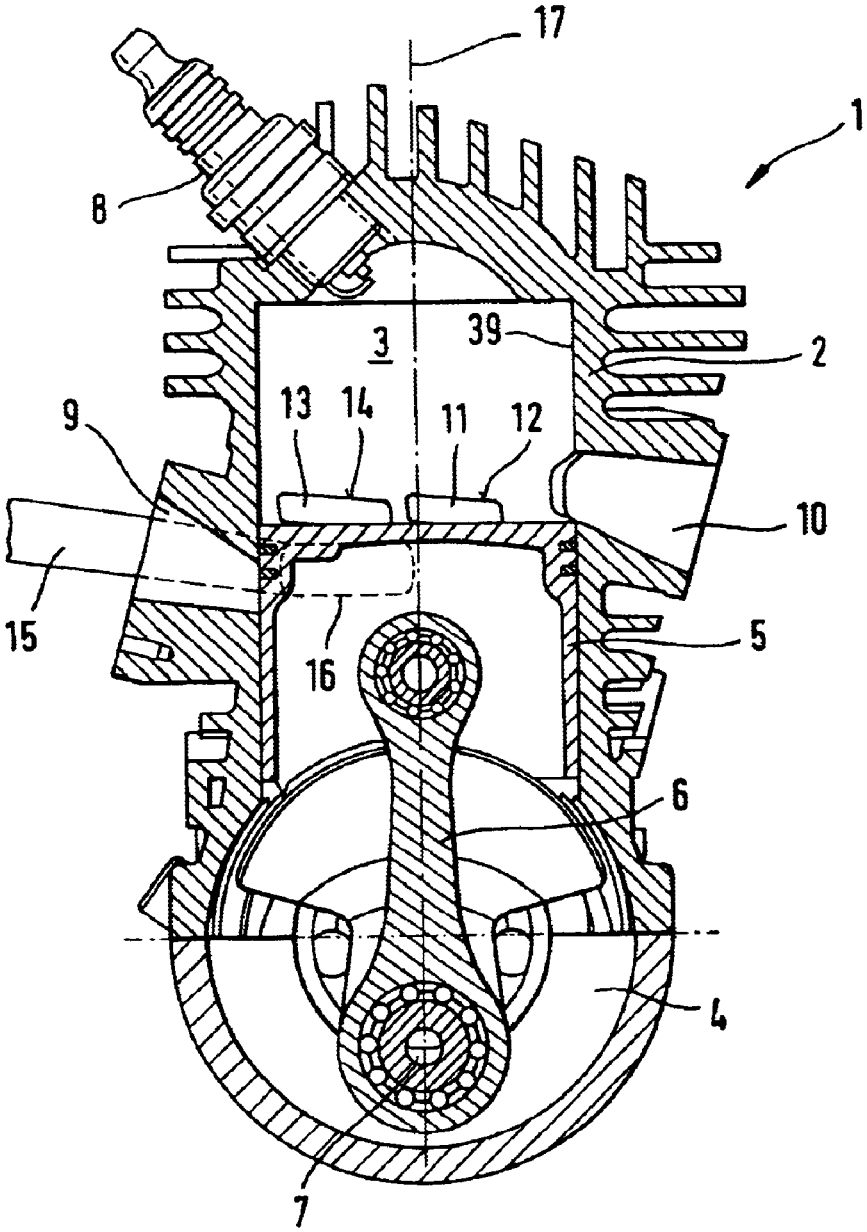
FIG. 1 is a longitudinal cross-sectional view through a two-cycle engine.

The two-cycle engine of the present invention comprises a cylinder in which is formed a combustion chamber that is delimited by a reciprocating piston that, via a connecting rod, drives a crankshaft that is rotatably mounted in a crankcase, wherein in prescribed positions of the piston, the combustion chamber is connected with the crankcase via at least two transfer channels, wherein at least one air channel is provided that opens out at an air channel window at the cylinder in a region of the piston and that, in prescribed positions of the piston, is connected with at least two of the transfer channels via a piston window that is formed in the piston, and wherein structural means are provided on the piston window for a defined distribution of air to the transfer channels.

The structural means permit, in a straightforward manner, a defined distribution of the air to the transfer channels. In this connection, the structural means can be designed such that each transfer channel is supplied with that much air that is necessary for a good separation between the exhaust gases and the subsequently flowing-in fuel/air mixture. In this way, the fuel consumption of the engine can be reduced, and the exhaust gas values of the engine can be improved.

The means for the defined distribution of the air advantageously narrow the flow cross-section. It is provided that the means for the defined distribution of the air be disposed in a region that in the direction of flow is disposed approximately at a level or height between a transfer channel that is near the outlet and a transfer channel that is remote from the outlet. Customarily, too much air is supplied to the transfer channel that is near the outlet, while too little air is supplied to the transfer channel that is remote from the outlet and is disposed in the region of the air inlet window. As a result of the narrowing of the flow cross-section, the fraction of the air that is supplied to the transfer channel that is remote from the outlet can be increased. A straightforward configuration results if the means for the defined distribution of the air includes a raised portion in the piston window; the depth of the piston window is reduced at the raised portion. In this connection, the raised portion is in particular embodied as an edge between two concavely configured portions of the wall of the piston window.

A defined distribution of the air to the transfer channels can be achieved if the piston window is flatter in the region of a transfer channel that is near the outlet than in the region of a transfer channel that is remote from the outlet. The means advantageously include a nose that is formed on an eye of the piston and that extends into the piston window. It is possible to influence the distribution of the air to the transfer channels by means of the size of the nose.

It is provided that the means include a control edge that delimits the piston window. The control edge that faces the crankcase, in the region of a transfer channel that is near the outlet, is advantageously offset relative to the control edge, in the region of a transfer channel that is remote from the outlet, by a distance in the direction toward the piston head. As a consequence of the offset of the control edge, largely fuel-free air from the air channel is supplied to the transfer channel that is near the outlet for a shorter period of time during a piston stroke than is the case for the transfer channel that is remote from the outlet.

It can also be expedient that the control edge that faces the piston head, in a region of a transfer channel that is near the outlet, be offset in the direction toward the piston head by a distance relative to the control edge that is in the region of a transfer channel that is remote from the outlet.

In order to influence the direction of flow in the piston window, it is provided that the means for the distribution of the air include a ramp at the entry of flow into the piston window. The ramp guides the flow that enters the piston window, so that a desired distribution of air can be achieved.

Four transfer channels are advantageously provided and are disposed symmetrically relative to a central plane that approximately centrally divides the outlet and inlet; the transfer channels communicate with a respective air channel window via two symmetrically disposed piston windows. By means of the symmetrical arrangement of the piston windows and of the transfer channels, a symmetrical scavenging of the combustion can be achieved. Consequently, good exhaust gas values are achieved. In this connection, the air channel window is in particular disposed in the region of a transfer channel that is remote from the outlet.

At least one control edge that delimits the piston window is, in a first region, expediently offset relative to a second region of the control edge in the direction of the longitudinal central axis of the cylinder, whereby in the circumferential direction of the piston, the second region has a greater spacing or distance relative to the outlet than does the first region. As a consequence of the offset of the control edges, different control times can be realized at which the transfer channels are opened or closed. Since the filling of the transfer channels with air from the air channel begins or ends at different times, different air quantities result, so that by means of the offset of the control edges, the distribution of the air to the transfer channels can be influenced in a practical manner.

Further specific features of the present invention will be described in detail subsequently.

DESCRIPTION OF PREFERRED EMBODIMENTS

Referring now to the drawings in detail, the two-cycle engine 1, which is illustrated in a longitudinal cross-sectional view in FIG. 1, has a cylinder 2 in which is formed a combustion chamber 3. The combustion chamber 3 is delimited by the piston 5 that reciprocates in the cylinder 2. An inlet 9 leads into the combustion chamber 3, and an outlet 10 leads out of the combustion chamber. By means of a connecting rod 6, the piston 5 drives a crankshaft 7 that is rotatably mounted in a crankcase 4. In the position of the piston 5 shown in FIG. 1, the crankcase 4 is connected with the combustion chamber 3 via transfer channels 11 that are disposed close to the outlet 10, and transfer channels 13 that are disposed remote from the outlet. In this connection, respectively two transfer channels 11 that are disposed close to the outlet 10, and two transfer channels 13 that are disposed remote from the outlet, are disposed symmetrically relative to a central plane that approximately centrally divides the inlet 9 and the outlet 10. In this connection, the central plane includes the longitudinal central axis 17 of the cylinder 2. The transfer channels 11 that are disposed close to the outlet 10 open via transfer windows 12 into the combustion chamber 3, and the transfer channels 11 that are disposed remote from the outlet open into the combustion chamber via transfer windows 14. At the cylinder 2, an air channel 15 opens out at two air channel windows 16 that are disposed symmetrically relative to the central plane. In this connection, the air channel windows 16 are offset at the cylinder bore 39 relative to the transfer windows 14 that are remote from the outlet in a direction toward the crankcase 4.

During operation of the two-cycle engine 1, in the position of the piston 5 illustrated in FIG. 1 fuel/air mixture flows out of the crankcase 4 and through the transfer channels 11 and 13 into the combustion chamber 3. By movement of the piston 5 in a direction toward the combustion chamber 3, the mixture in the combustion chamber is compressed and is ignited by a spark plug 8 in a region of the upper dead center position of the piston 5. During the thereupon following downward movement of the piston 5 in a direction toward the crankcase 4, first the outlet 10 opens, through which the exhaust gases can go out of the combustion chamber 3. In the region of the upper dead center position of the piston, largely fuel-free air from the air channel 15 is preliminarily introduced into the transfer channels 11 and 13 via a non-illustrated window. The preliminarily introduced and stored air flows, in the region of the upper dead center position 5, into the combustion chamber 3 and separates the exhaust gases from the subsequently in-flowing fuel/air mixture from the crankcase 4.

Figure 2:
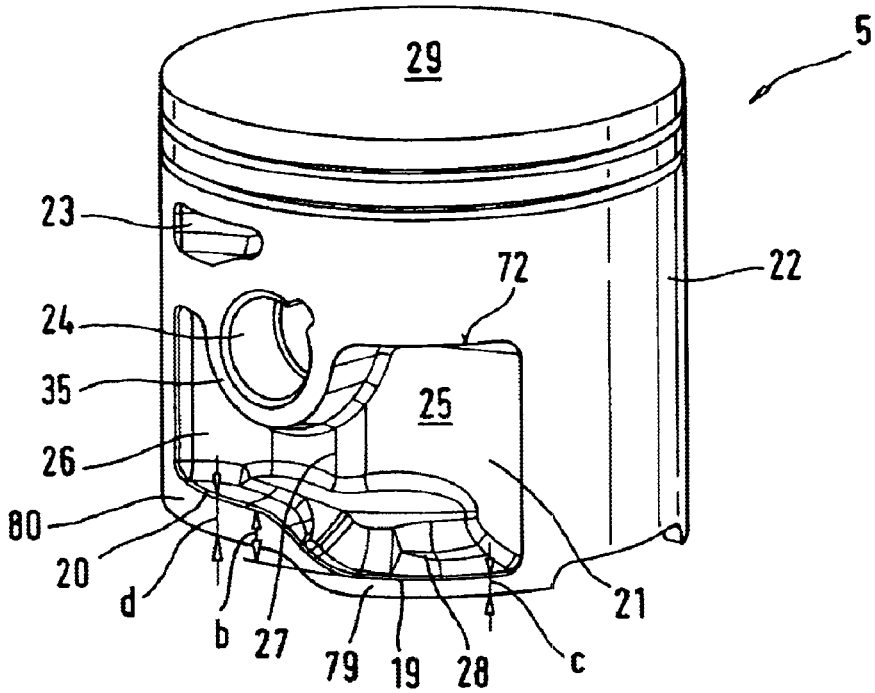
FIG. 2 is a perspective view of a piston.
Figure 3:
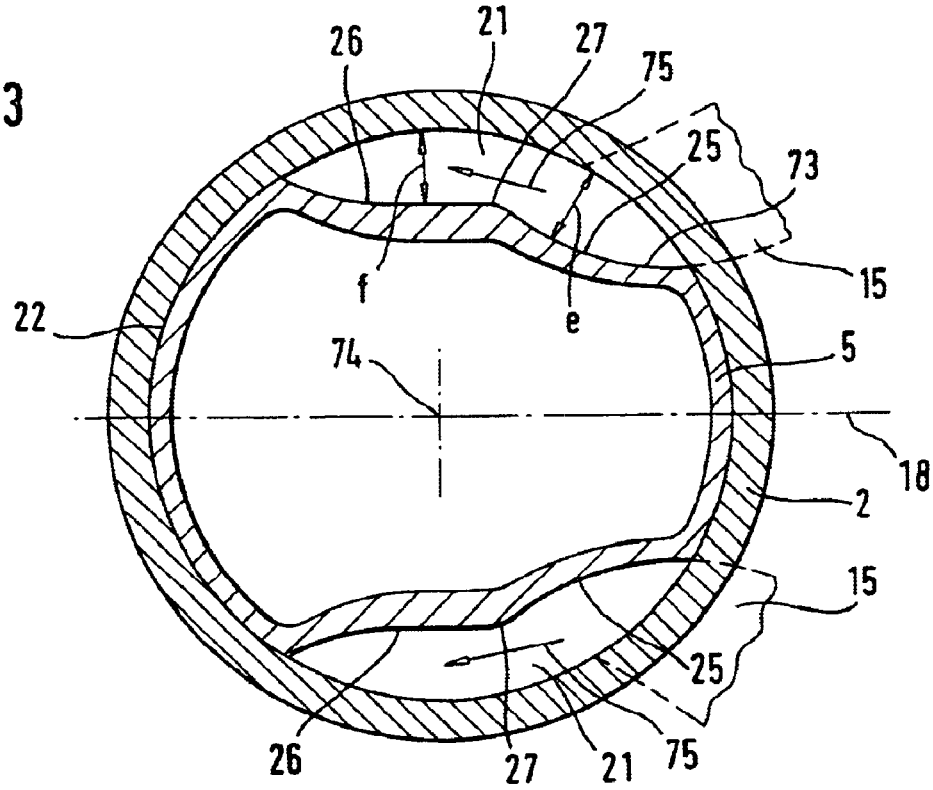
FIG. 3 is a cross-sectional view through the piston of FIG. 2 approximately at the level of the piston window.

The piston 5 is shown in FIGS. 2 and 3. As shown in FIG. 3, the piston 5 has two piston windows 21 that are disposed symmetrically relative to the central plane 18. The piston windows 21 extend from the piston skirt 22 into the interior of the piston 5. The piston 5 is connected with the connecting rod 6 of FIG. 1 via a non-illustrated bolt or pin that is disposed in the piston eye 24. As shown in FIG. 2, the piston eye 24 is disposed in the region of a control edge 72 that delimits the piston window 21 in a direction toward the piston head 29. The edge 35, which extends between the piston eye 24 and the piston window 21, is configured in such a way that it forms a seal with the cylinder bore 39 during operation of the two-cycle engine 1, so that a flow is prevented between the piston or connecting rod eye 24 that is connected with the crankcase, and the piston window 21. The edge 35 thus extends to the periphery of the piston 5. Disposed in the piston 5 on that side of the piston window 21 that faces the piston head 29 is a cavitation 23 that extends from the piston skirt 22 into the interior of the piston 5, and that serves for reducing the weight of the piston.

As indicated in FIG. 3, in the region of the upper dead center position of the piston 5, air flows out of the air channels 15 in the direction of flow 75 through the piston window 21. The wall 73 of the piston window 21 has a first concave portion 25 that faces the air channel 15, as well as a second concave portion 26 that faces away from the air channel. The two concave portions 25, 26 contact one another at a raised portion 27 that is embodied as an edge between the two concave portions. The depth e in the first concave portion 25, as measured radially relative to the longitudinal central axis 74 of the piston 5, is greater than the depth f in the second concave portion 26. The piston window 21 thus extends more flatly in the second concave portion 26 than in the first concave portion 25.

The first concave portion 25 is disposed in the cylinder 2 of the two-cycle engine 1 in the region of the transfer channel 13 that is remote from the outlet 10, and the second concave portion 26 is disposed in the region of the transfer channel 11 that is near the outlet. The raised portion 27 leads to a narrowing of the flow cross-section in the piston window 21. As a result, the quantity of air supplied to the transfer channel 11 that is close to the outlet 10 is reduced. For the distribution of the air to the transfer channels, a ramp 28, which is shown in FIG. 2, is disposed in the piston window 21 in the in-flow region into the piston window, on that side of the piston 5 that faces the crankcase 4. The ramp 28 guides the flow in the piston window 21. The piston window 21 is delimited at the first concave portion 25, in a direction toward the crankcase 4, by a control edge 19 that is formed on an edge 79 of the piston 5. From the second concave portion 26, the piston window 21 is delimited by the control edge 20, which is formed on an edge 80. The edge 79 has a width c, which is measured parallel to the longitudinal central axis 74 of the piston 5, and which is less than the width d of the edge 80, which is measured parallel to the longitudinal central axis 74. Due to the wider configuration of the edge 80, the control edge 20 is offset relative to the control edge 19 in the direction toward the piston head 29 by a distance b. As a result, the supply of air to the transfer channel 11 that is near the outlet 10 can be reduced. In addition, the edge 80 is offset relative to the edge 79 in the direction toward the piston head 29.

Figure 4:
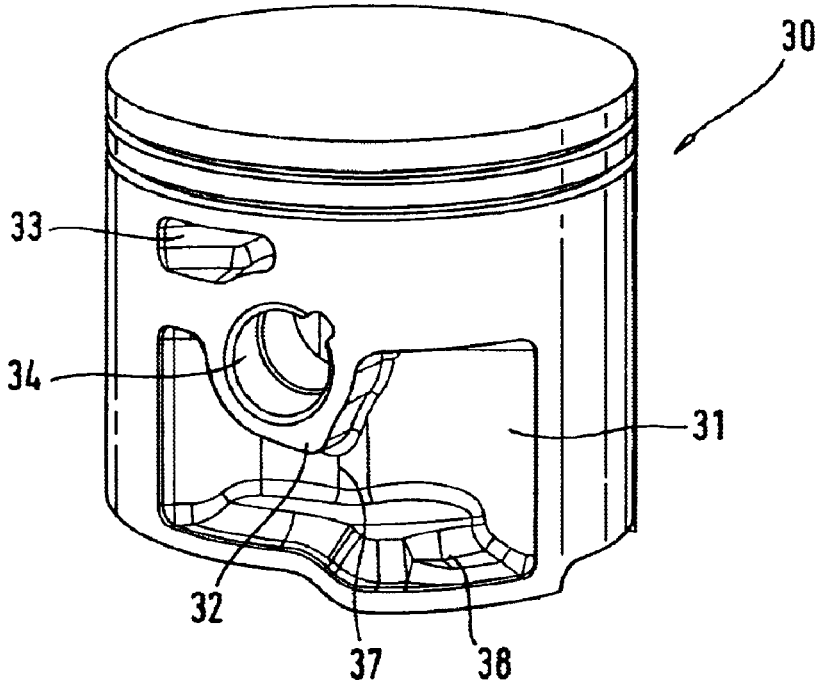
FIGS. 4–7 are perspective views of pistons

An embodiment of a piston 30 is illustrated in FIG. 4. The piston 30 has a piston window 31 that is provided with a projection or raised portion 37, as well as a ramp 38, for the distribution of the air to the transfer channels. In addition, a nose 32 is disposed on the piston eye 34 of the piston 30; the nose 32 extends in a direction toward the crankcase 4 and reduces the flow cross-section in the piston window 31. The piston 30 is furthermore provided with a cavitation 33 for reducing the weight of the piston.

Figure 5:
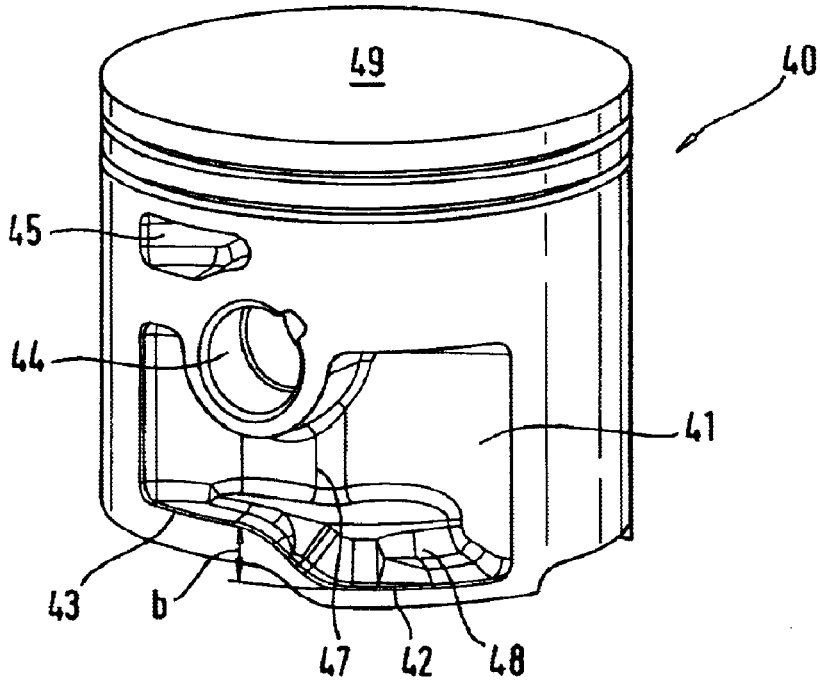

FIG. 5 shows a piston 40, the piston window 41 of which is provided with a ramp 48 as well as a raised portion 47 for reducing the flow cross-section. The control edge 43 in the region of the transfer channel that is near the outlet is offset in the direction toward the piston head 49 relative to the control edge 42 in the region of the transfer channel that is remote from the outlet by a distance b, so that the piston window 41 is connected with the transfer channel that is near the outlet for a shorter duration during each piston stroke than it is with the transfer channel that is remote from the outlet. The offset of the control edges 42, 43 is achieved as with the piston 5 illustrated in FIG. 2, by a widening of the edge or rim of the piston 40. The piston 40 also has a cavitation 45 for reducing the weight, and a piston eye 44 that is disposed in the region of the piston window 41.

Figure 6:
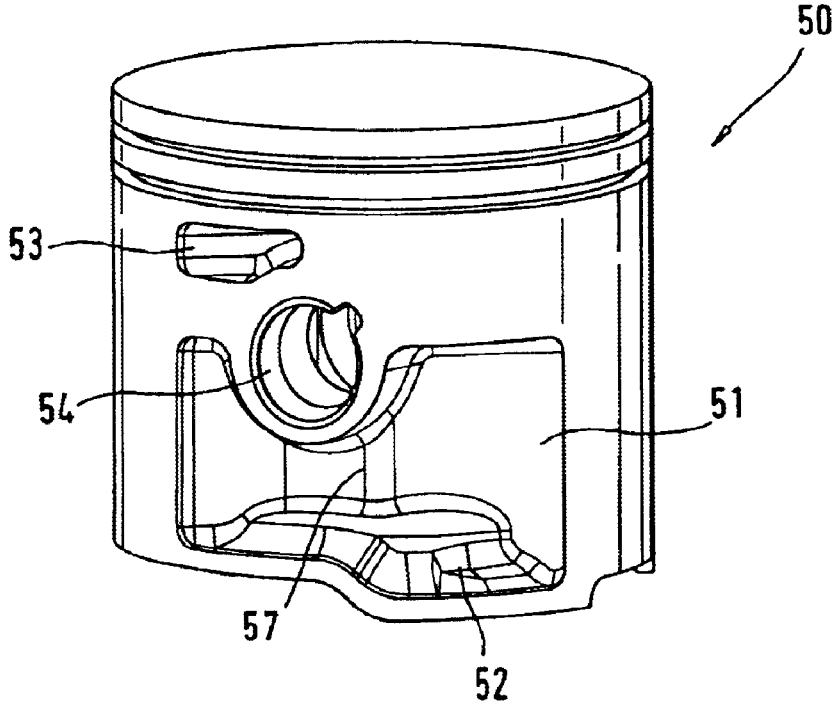

With the piston 50 shown in FIG. 6, for the distribution of the air to the transfer channels, a ramp 52 as well as a raised portion 57 are disposed in the piston window 51. The piston 50 also has a cavitation 53 as well as the piston eye 54, which is disposed in the region of the piston window 51.

Figure 7:
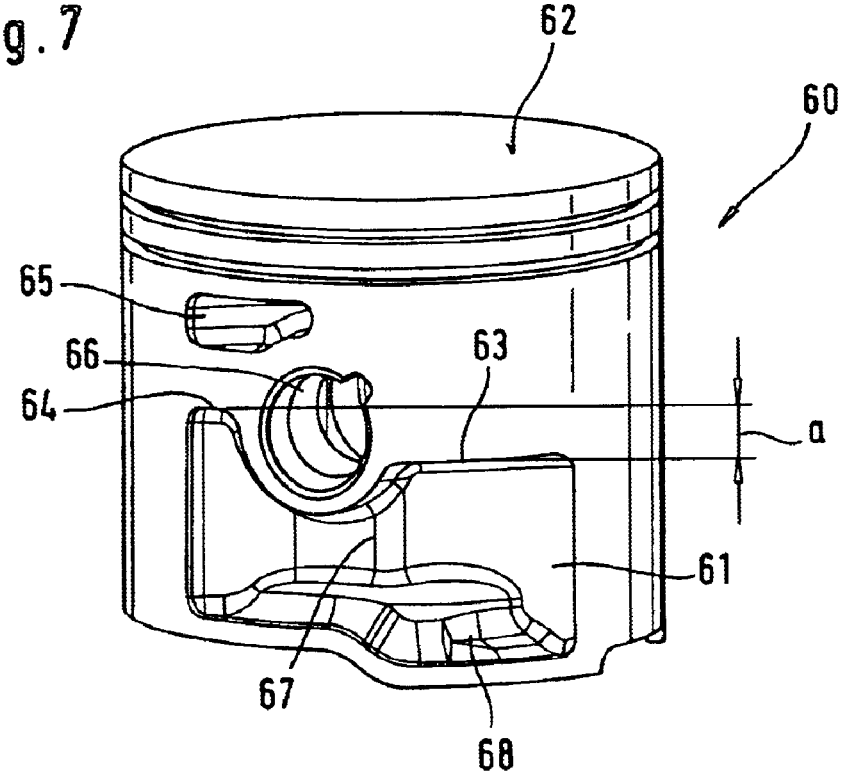

In the piston 60 shown in FIG. 7, the control edge 64 of the piston window 61 that faces the piston head 62, and which is disposed in the region of the transfer channel that is near the outlet, is offset by a distance a in the direction toward the piston head 62 relative to the control edge 63, which is disposed in the region of the transfer channel that is remote from the outlet. In this connection, the piston eye 66 is disposed at a level between the control edges 63 and 64. For the distribution of the air, the piston window 61 additionally has a raised portion 67 as well as a ramp 68. The piston 60 is provided with a cavitation 65 in the region of the transfer channel that is near the outlet.

To adapt the piston window to the desired distribution of the air to the transfer channels, other combinations of the means for distributing the air, as well as further means for distributing the air, can also be advantageous. A plurality of cavitations for reducing the weight of the pistons can also be provided.

The specification incorporates by reference the disclosure of German priority documents DE 102 23 068.4 filed May 24, 2002 and DE 103 12 092.0 filed Mar. 19, 2003.

The present invention is, of course, in no way restricted to the specific disclosure of the specification and drawings, but also encompasses any modifications within the scope of the appended claims.

What is claimed is:

1. A two-cycle engine, comprising:

a cylinder in which is formed a combustion chamber that is delimited by a reciprocating piston that, via a connecting rod, drives a crankshaft that is rotatably mounted in a crankcase, wherein in prescribed positions of said piston, said combustion chamber is connected with said crankcase via at least two transfer channels, wherein at least one air channel is provided that opens out at an air channel window at said cylinder in a region of said piston and that, in prescribed positions of said piston, is connected with at least two of said transfer channels via a piston window that is formed in said piston, and wherein structural means are provided on said piston window for a defined distribution of air to said transfer channels.

2. A two-cycle engine according to claim 1, wherein said means for a defined distribution of air narrows a flow cross-section in said piston window.

3. A two-cycle engine according to claim 1, wherein said means for a defined distribution of air is disposed in a region that, in the direction of flow, is disposed approximately at a level between a transfer channel that is near an outlet, and a transfer channel that is remote from said outlet.

4. A two-cycle engine according to claim 1, wherein said means for a defined distribution of air includes a raised portion in said piston window at which a depth of said piston window is reduced.

5. A two-cycle engine according to claim 4, wherein said raised portion is embodied as an edge between two concavely configured portions of a wall of said piston window.

6. A two-cycle engine according to claim 2, wherein said piston window extends in a flatter manner in the region of a transfer channel that is near an outlet than in the region of a transfer channel that remote from said outlet.

7. A two-cycle engine according to claim 1, wherein said means for a defined distribution of air includes a nose formed on an eye of said piston, and wherein said nose extends into said piston window.

8. A two-cycle engine according to claim 1, wherein said means for a defined distribution of air includes a control edge that defines said piston window.

9. A two-cycle engine according to claim 8, wherein a control edge that faces said crankcase, in the region of a transfer channel that is near an outlet, is offset relative to a control edge in the region of a transfer channel that is remote from said outlet, by a distance in a direction toward a piston head.

10. A two-cycle engine according to claim 8, wherein a control edge that faces a piston head, in the region of a transfer channel that is near an outlet, is offset in the direction toward said piston head by a distance relative to a control edge in the region of a transfer channel that is remote from said outlet.

11. A two-cycle engine according to claim 1, wherein said means for a defined distribution of air includes a ramp at a flow inlet into said piston window.

12. A two-cycle engine according to claim 1, wherein four transfer channels are provided that are disposed symmetrically relative to a central plane that approximately centrally divides an inlet and an outlet, and wherein said transfer channels communicate with a respective air channel window via two symmetrically arranged piston windows.

13. A two-cycle engine according to claim 1, wherein said air channel window is disposed in the region of a transfer channel that is remote from an outlet.

14. A two-cycle engine according to claim 8, wherein at least one control edge that defines said piston window has a first region that, in a direction of a longitudinal central axis of said cylinder, is offset relative to a second region of said control edge and wherein said second region, in a circumferential direction of said piston has a greater distance relative to an outlet than does said first region.

* * * * *